US009255498B2

(12) United States Patent
Brodbeck et al.

(10) Patent No.: US 9,255,498 B2
(45) Date of Patent: Feb. 9, 2016

(54) VARIABLE VALVE PHASING LIFT AND DURATION

(71) Applicant: Mahle International GmbH, Stuttgart (DE)

(72) Inventors: Luke Brodbeck, Brighton, MI (US); Falk Schneider, Korntal-Muenchingen (DE); Thomas Flender, Eberdingen (DE); Antonio Menonna, Ditzingen (DE); Michael Kreisig, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/959,073

(22) Filed: Aug. 5, 2013

(65) Prior Publication Data

US 2014/0033998 A1 Feb. 6, 2014

Related U.S. Application Data

(60) Provisional application No. 61/680,072, filed on Aug. 6, 2012.

(51) Int. Cl.

| | |
|---|---|
| ***F01L 1/34*** | (2006.01) |
| ***F01L 1/344*** | (2006.01) |
| ***F01L 9/02*** | (2006.01) |

(52) U.S. Cl.

CPC . *F01L 1/34* (2013.01); *F01L 1/344* (2013.01); *F01L 9/025* (2013.01); *Y10T 29/49293* (2015.01)

(58) Field of Classification Search

CPC ..... F01L 1/34; F01L 1/344; F01L 9/025

USPC ..... 123/90.12, 90.6, 90.16, 90.15, 90.17

See application file for complete search history.

(56) References Cited

U.S. PATENT DOCUMENTS

| | | | | |
|---|---|---|---|---|
| 2,019,252 | A | 10/1935 | Cottingham | |
| 2,888,837 | A | 6/1959 | Hellmann | |
| 3,516,394 | A | 6/1970 | Nichols | |
| 5,813,377 | A * | 9/1998 | Matsunaga | 123/90.17 |
| 6,227,154 | B1 * | 5/2001 | Wakeman | 123/90.16 |
| 6,343,581 | B2 * | 2/2002 | Suzuki | 123/90.17 |

(Continued)

FOREIGN PATENT DOCUMENTS

| | | |
|---|---|---|
| EP | 0027949 A1 | 5/1981 |
| EP | 0317372 A1 | 5/1989 |

(Continued)

OTHER PUBLICATIONS

English Abstract of EP 0027949.

EP Search Report for EP 13179423 dated Dec. 3, 2013.

*Primary Examiner* — Ching Chang

(74) *Attorney, Agent, or Firm* — Fishman Stewart Yamaguchi PLLC

(57) ABSTRACT

Various exemplary illustrations of a camshaft assembly for actuating valves of an engine are disclosed. The camshaft assembly may include a camshaft having a plurality of lobes, including at least one phase adjustable lobe configured to be selectively rotated with respect to the camshaft. The assembly may further include a hydraulic valve actuator in communication with a first lobe of the camshaft. The hydraulic valve actuator may be configured to selectively actuate at least one valve in communication with the hydraulic valve actuator in response to the at least one cam lobe.

21 Claims, 4 Drawing Sheets

(56) References Cited

U.S. PATENT DOCUMENTS

| | | | | |
|---|---|---|---|---|
| 6,530,350 | B2 * | 3/2003 | Chiappini et al. | 123/90.12 |
| 7,503,293 | B2 * | 3/2009 | Lettmann et al. | 123/90.15 |
| 2010/0224147 | A1 | 9/2010 | Clever et al. | |

FOREIGN PATENT DOCUMENTS

| | | | |
|---|---|---|---|
| EP | 0939205 | A1 | 9/1999 |
| EP | 2282022 | A1 | 2/2011 |
| GB | 2348245 | A | 9/2000 |

* cited by examiner

VARIABLE VALVE PHASING LIFT AND DURATION

CROSS-REFERENCE TO RELATED APPLICATIONS

This application claims priority to U.S. Provisional Application Ser. No. 61/680,072, filed on Aug. 6, 2012, the contents of which are hereby expressly incorporated by reference in its entirety.

BACKGROUND

Camshaft phasing mechanisms allow selective adjustment of valve timing for internal combustion engines by selectively advancing or retarding the positions at least some of the lobes on a camshaft, thereby allowing associated valve movements to occur either earlier or later in the gas exchange cycle. For example, engines may operate more efficiently or effectively during one set of operating conditions when the valve timing is advanced, i.e., such that a valve(s) movement occurs earlier during the combustion cycle. Additionally, it may be desirable during a second set of operating conditions to retard the valve timing, i.e., such that a valve(s) movement occurs later during the gas exchange cycle. Adjusting the relative positions of at least some of the lobes on a camshaft allows internal combustion engines to operate with improved fuel economy, torque, and emissions.

Lobes of a camshaft may be used to open and close valves or to actuate pushrods which in turn open and close valves of an engine. While cam phasing mechanisms are useful, they may still suffer from inherent limitations of mechanical valve actuation systems. For example, lift and duration of a valve may be generally incapable of being adjusted during engine operation. As a result, valve opening and/or closing parameters of an engine may not be ideal across all engine operating conditions.

Accordingly, there is a need for a camshaft assembly that addresses the above problems.

BRIEF DESCRIPTION OF THE DRAWINGS

Referring now to the drawings, exemplary illustrations are shown in detail. Although the drawings represent representative examples, the drawings are not necessarily to scale and certain features may be exaggerated to better illustrate and explain an innovative aspect of an illustrative example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows.

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Exemplary illustrations are provided herein of a camshaft assembly for actuating valves of an engine. The assembly may include a camshaft having a plurality of lobes, including at least one phase adjustable lobe configured to be selectively rotated with respect to the camshaft. The assembly may further include a hydraulic valve actuator in communication with a first lobe of the camshaft. The hydraulic valve actuator may be configured to selectively actuate at least one valve in communication with the hydraulic valve actuator in response to the at least one cam lobe.

Exemplary methods of assembling a camshaft are also provided. An exemplary method may include providing a camshaft having a plurality of lobes, including at least one phase adjustable lobe configured to be selectively rotated with respect to the camshaft. The method may further include placing a hydraulic valve actuator in mechanical communication with a first lobe of the camshaft. The hydraulic valve actuator configured to selectively actuate a valve in response to the first lobe, i.e., thereby selectively de-coupling the valve from the lobe, or reducing a force transmitted to the valve from the lobe during engine operation.

As will be described further below, a camshaft and associated valve train may allow for fully variable valve actuation, where valve phasing, lift, and duration may be independently controlled for valves of a single cylinder of a combustion engine. In one example, a device and corresponding method for a hydraulic valve actuation system employs a fully variable control of valves for internal combustion engines, e.g., gasoline or compression ignition engines. The valves may be controlled indirectly via intermediate hydraulic chambers, rather than directly by the camshaft. These chambers may open the valves by means of hydraulic (e.g., oil) pressure. More specifically, if the pressure is discharged by a controlled solenoid valve, the valve will not open even if the cam is in the lift phase. In this manner, valves may be selectively disconnected from actuation via the camshaft.

Figure 1:
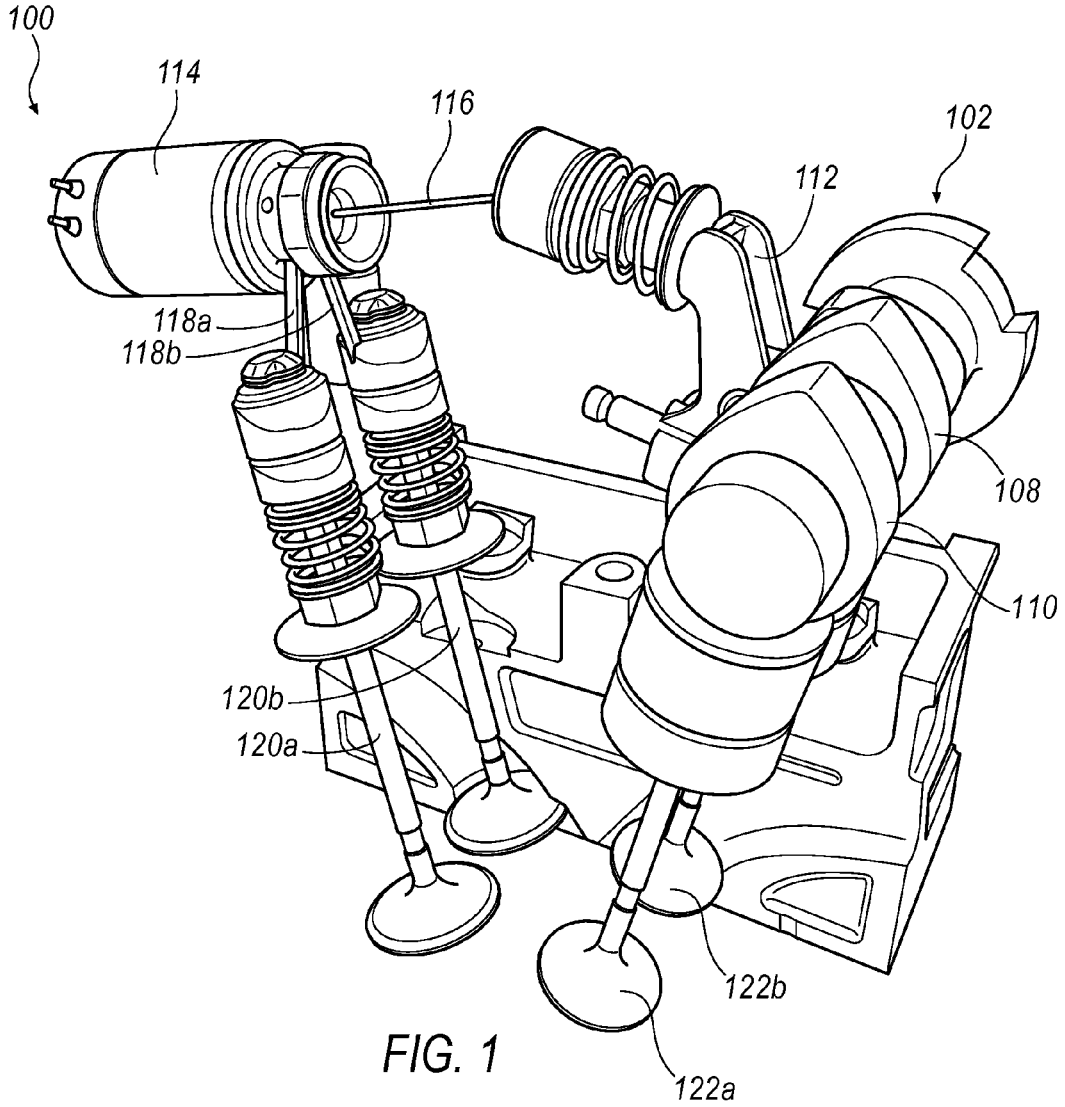
FIG. 1 is a perspective view of an exemplary valve train including a phase-adjustable camshaft assembly and a hydraulic valve actuation system.

Referring now to FIG. 1, an exemplary system may include a camshaft assembly including a camshaft 102 having a plurality of lobes 108, 110. While the camshaft assembly 102 is shown actuating four valves 120, 122 for a single engine cylinder (not shown), the camshaft 102 may be employed to actuate any number of valves for a given engine cylinder that is convenient. Moreover, as is common for internal combustion engines, the camshaft assembly 102 may actuate valves for multiple cylinders of an engine.

Figure 2:
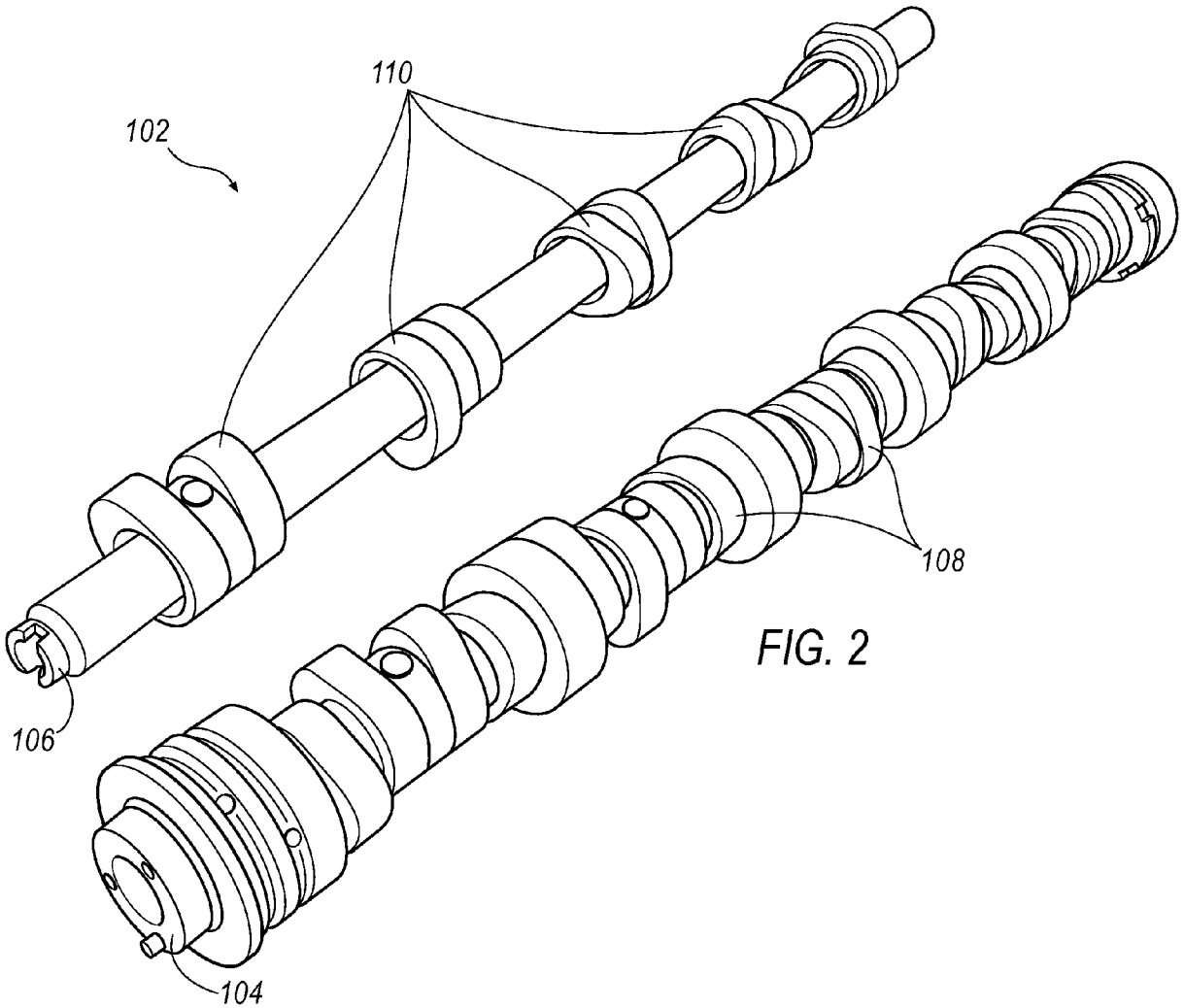
FIG. 2 illustrates a perspective view of an exemplary camshaft assembly.
Figure 3A:
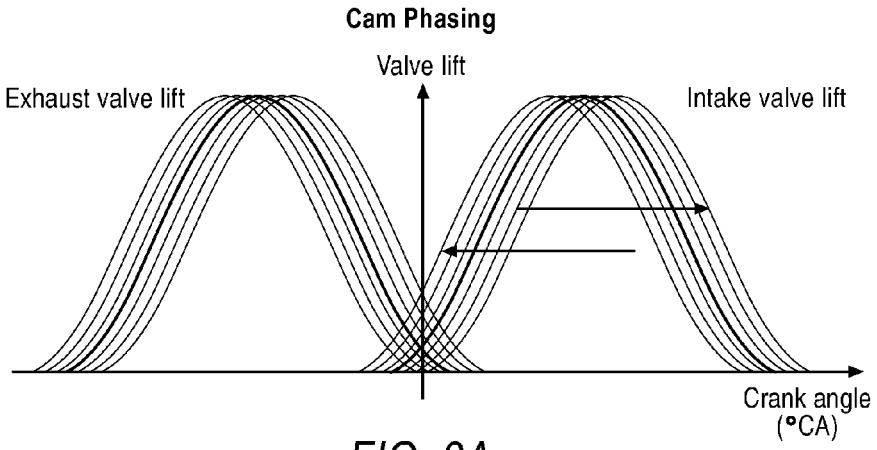
FIG. 3A illustrates a graph of valve lift versus crank angle for an exemplary valve train to show exemplary phase adjustments.

The lobes 108, 110 may generally be selectively phased with respect to the camshaft 102 and/or other lobes 108, 110. Accordingly, the lobe 108 of the camshaft may be selectively rotatable about the camshaft 102 with respect to at least one other camshaft lobe 110. As best seen in FIG. 2, in some exemplary approaches an inner camshaft 106 and an outer camshaft 104 are employed to provide selective phasing of camshaft lobes 108 and/or 110. For example, the inner camshaft 106 may define one or more camshaft lobes 110 that may selectively fixed to the inner camshaft 106 to allow the lobes 110 to be phased or adjusted rotationally with respect to the inner camshaft 106. The outer camshaft 104 may define one or more lobes 108 that are fixed with respect to the outer camshaft 108. In this manner, the lobes 108, 110 of the camshaft may generally be phased or adjusted with respect to each other. Moreover, the lobes 110 of the camshaft assembly 102 are configured to be phased with respect to the camshaft assembly 102. The lobes 108, 110 may generally actuate associated valves 122*a*, 122*b*. A phase-adjustable lobe of the camshaft 102 may be used to actuate and adjust the phasing of either an intake valve or exhaust valve of an engine cylinder, as shown in FIG. 3A. More specifically, an intake valve and/or an exhaust valve lift may be delayed or advanced using a phase-adjustable lobe of a camshaft. Moreover, two intake or two exhaust valves associated with an engine cylinder may be phased with respect to one another. For example, a first intake valve may be phased with respect to a second intake valve, thereby facilitating increased swirling of an intake mixture during engine operation.

The camshaft assembly may include at least a third separate lobe, which may itself be fixed to the inner or outer camshaft, which actuates a cam follower 112. The cam follower in turn actuates a hydraulic valve actuation system by way of a pushrod 116. The hydraulic valve actuation system may selectively actuate valves 120*a*, 120*b*, which may be associated with the same cylinder as the valves 122*a*, 122*b* actuated by the lobes 108, 110 of the camshaft 102. More specifically, valve links 118*a*, 118*b* may be selectively actuated by pressure transferred from a reservoir 114, thereby selectively opening and closing the valves 120*a*, 120*b*. The reservoir 114, in turn, is actuated by way of a pushrod 116 which is actuated by the cam follower 112. In one exemplary approach, the hydraulic actuation system is a "UniAir" system.

Figure 3B:
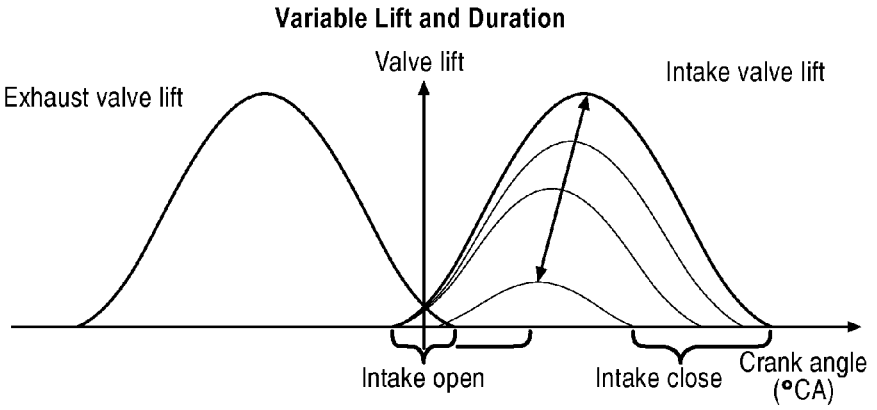
FIG. 3B illustrates a graph of valve lift versus crank angle for an exemplary valve train to show exemplary lift and duration adjustments.

The hydraulic valve actuation system may advantageously adjust duration and/or lift of the valves 122*a*, 122*b*, as illustrated in FIG. 3B. More specifically, a magnitude of a lift of a valve may be adjusted by increasing or decreasing travel of a valve, resulting in corresponding increases or decreases in the amplitude of a valve lift, e.g., an intake valve as shown in FIG. 3B. Duration of a valve opening may also be increased or decreased by increasing or decreasing the length of time that a hydraulic valve actuation system holds a valve open, i.e., in response to the cam follower 112.

As noted above, in one exemplary illustration the hydraulic valve actuation system employs a reservoir 114 which selectively opens and closes a solenoid (not shown) to allow for selective deactivation of the mechanical link between the cam follower 112 and the valves 120, thereby selectively stopping reciprocating motion of the valves 120 while the camshaft 102 continues to rotate. The reservoir 114 may contain, oil, air, or any other hydraulic medium that is convenient. When the solenoid is closed, the reservoir 114 is generally sealed and may transfer pressure from the pushrod 116 to the links 118. Accordingly, while the solenoid is closed, the reservoir 114 serves as a mechanical link acting between the pushrod 116 and the links 118 such that the valves 120 respond directly to movement of the cam follower 112. By contrast, when the solenoid is open, the reservoir 114 is no longer sealed and hydraulic fluid may be permitted to escape from the reservoir 114. As such, when the pushrod 116 is urged toward the reservoir 114 by the cam follower 112, the valves 120*a*, 120*b* do not move. In this manner, the valves 120 are selectively disconnected from direct movement in response to the cam follower 112. The reservoir 114 and solenoid may also facilitate selective adjustment of response characteristics of the valves 120, e.g., lift and/or duration, with respect to the cam follower 112. For example, the solenoid may be opened during actuation, i.e., while a valve is fully or partially actuated, thereby disconnecting the valve 120 from the cam follower 112 and allowing the valve 120 to return to a position urged by an associated valve spring. In this manner, movement characteristics of the valves 120, e.g., lift and/or duration, may be adjusted by selectively opening and closing the solenoid of the reservoir 114.

An exemplary hydraulic actuation system may be used in any number of ways with a camshaft assembly to actuate one or more valves associated with an engine cylinder and also effect adjustments to phase, duration, and/or lift of the valve(s). In one exemplary illustration, a "single acting" valve train system includes three camshaft lobes defined by a camshaft assembly. For example, a first camshaft lobe 108 may be fixed to an outer camshaft 104. The first camshaft lobe 108 may selectively actuate an exemplary hydraulic valve actuation system. The hydraulic valve actuation system allows for adjustment of valve lift and duration. Two additional lobes, e.g., lobes 110, may be selectively fixed to an inner camshaft 106 for rotation therewith, while also allowing the two lobes 110 (and their associated valve(s)) to be phased, or adjusted rotationally, with respect to the inner shaft 106. In this manner, a first valve of an engine cylinder may be actuated by the hydraulic valve actuation system may be adjustable for lift and duration, while a second valve of the engine cylinder may be actuated by phase-adjustable lobes of the camshaft. In one exemplary illustration of advantages of such a system, an intake valve may be phased to enable late intake valve closing, while the hydraulic valve actuator reduces duration of the exhaust valves to enable a short exhaust opening for improved exhaust pulse separation.

In another exemplary illustration, a "dual acting" valve train system includes two lobes 110 that are fixed to an inner camshaft 106. A third lobe 108 is fixed to an outer camshaft 104. The third lobe 108 may be selectively fixed to the outer camshaft 104 to allow the third lobe 108 to be phased with respect to the outer shaft 104. Accordingly, the third lobe 108 is phase-adjustable, and may act on the hydraulic actuator, e.g., by way of a cam follower 112 as described above. In this manner, the lift, duration, and phase of the valve(s) actuated by the third lobe 108 may be adjusted by way of the phase adjustable lobe 108 and the hydraulic actuation system.

In yet another exemplary illustration, another "single acting" valve train system includes a first camshaft lobe 108 and a second camshaft lobe 110, where the first lobe 108 is fixed to an outer camshaft 104, and the second lobe 110 is fixed to the inner camshaft 106. The inner camshaft 106 may allow for selective phasing of the second lobe 110. A third camshaft lobe 108, acting upon a hydraulic valve actuation system, may also be fixed to the outer camshaft 104.

Further exemplary illustrations will now be described regarding specific applications for the above exemplary valve train systems. According to a first example employing the "single-acting" example provided above, a hydraulic valve actuation system may be used to adjust lift and duration of the intake valves of an engine cylinder. More specifically, a camshaft 102 may selectively actuate the intake valves of an engine cylinder through the hydraulic valve actuation system via a cam follower 112. Additionally, the camshaft 102 may also selectively actuate exhaust valves of the same engine cylinder. Moreover, one or both exhaust valves actuated by the camshaft 102 may be phase-adjustable. More specifically, one or both exhaust valves of the engine cylinder may be adjusted to change timing of an opening and or closing of one or both exhaust valves. Accordingly, the intake valve(s) may be adjustable for lift and duration, while the exhaust valve(s) are phase adjustable, as may be advantageous for a gasoline engine application.

In another exemplary illustration, a gasoline engine may have intake valves for a given engine cylinder actuated directly by phase-adjustable cam lobes on a camshaft assembly. A cam follower 112 actuated by a third lobe disposed on the camshaft assembly may actuate a hydraulic valve actuation system, which actuates exhaust valve(s) associated with the same engine cylinder. Accordingly, a phase of one or both of the intake valves may be selectively adjusted using the phase adjustable lobes of the camshaft, while lift and/or duration of exhaust valves may also be selectively adjusted by the hydraulic valve actuation system. In one exemplary approach, a valve opening duration of an exhaust valve may be shortened to manage exhaust pressure. For example, a shortened valve opening duration may increase pulse separation in an exhaust manifold, e.g., of a 4 cylinder engine. Furthermore, in another exemplary approach two cam lobes 108 and/or 110 of a camshaft assembly may actuate exhaust valves of a cylinder, while a hydraulic valve actuator actuates an intake valve of the same cylinder. In this example, the exhaust valves may be phase-adjusted with respect to each other and may each employ shortened opening durations relative to a standard opening duration, thereby reducing exhaust pressure by increasing exhaust pulse separation. For example, one of the lobes 108/110 may be fixed to the camshaft while the other of the lobes 110/108 is phase-adjustable with respect to the camshaft.

In another exemplary illustration, a diesel engine may employ either a single acting or double acting system as described above.

Figure 4:
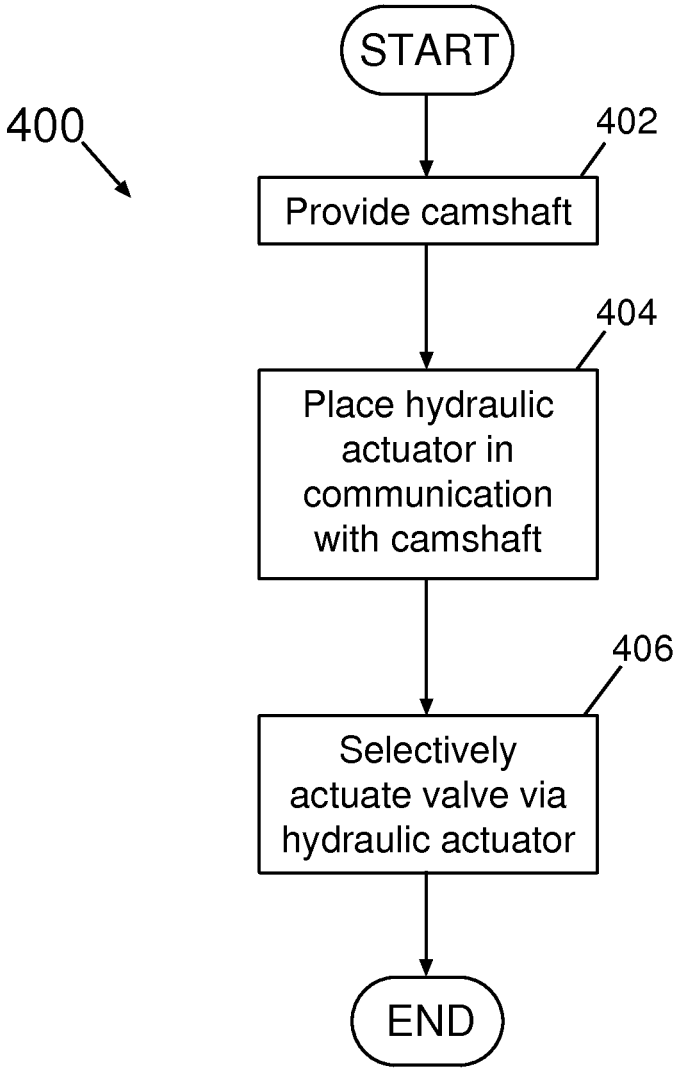
FIG. 4 is a process flow diagram of an exemplary method of actuating a valve.

Turning now to FIG. 4, an exemplary process 400 is illustrated for assembling a camshaft assembly. Process 400 may begin at block 402, where a camshaft is provided. For example, as described above, a camshaft 102 may be provided having a plurality of lobes 108, 110. At least one of the lobes of the camshaft may be phase adjustable, i.e., the lobe is configured to be selectively rotated with respect to the camshaft. One or more lobes of the camshaft may also be fixed rotationally with respect to the camshaft. In some exemplary approaches, the camshaft 102 may include an outer tubular shaft 104 and an inner shaft 106 received therein, as noted above.

Proceeding to block 404, a hydraulic valve actuator may be placed in mechanical communication with a first lobe of the camshaft. For example, as described above a hydraulic valve actuator may be configured to selectively actuate a valve 120 in response to the first lobe, e.g., by way of the cam follower 112. Process 400 may then proceed to block 406.

At block 406, one or more valves may be selectively actuated by the hydraulic valve actuator. For example, the hydraulic valve actuator may be de-coupled from an associated valve 120 by permitting fluid communication of a reservoir 114 of the hydraulic valve actuator, thereby reducing a force transmitted by the reservoir 114 to the valve 120. A solenoid may be provided which generally opens the reservoir 114, thereby preventing the reservoir 114 from transmitting force from the cam follower 112 to the valve 120. In some exemplary approaches, the solenoid may be only partially opened, such that a force transmitted from the cam follower 112 to the valve 120 is reduced but is not eliminated. Alternatively, the solenoid may be opened such that no force is transmitted from the cam follower 112 to the valve 120, i.e., the force transmitted is substantially zero.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. It is anticipated and intended that future developments will occur in the arts discussed herein, and that the disclosed systems and methods will be incorporated into such future embodiments. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A camshaft assembly for selectively actuating valves of an engine cylinder, comprising:

a camshaft having a plurality of lobes, including at least one phase adjustable lobe configured to be selectively rotated with respect to the camshaft; and a hydraulic valve actuator actuated by the at least one phase adjustable lobe of the camshaft, the hydraulic valve actuator configured to selectively actuate at least one valve in communication with the hydraulic valve actuator in response to the at least one phase adjustable lobe of the camshaft, the hydraulic valve actuator configured to selectively modify an input received from the at least one phase adjustable lobe of the camshaft such that the camshaft assembly is configured to adjust a phase and at least one of a lift and a duration of the at least one valve.

2. The camshaft assembly of claim 1, wherein the camshaft includes at least a second cam lobe defining a fixed valve phase with respect to the camshaft.

3. The camshaft assembly of claim 2, wherein said second cam lobe actuates an exhaust valve of a gasoline engine, wherein the hydraulic valve actuator selectively actuates at least one intake valve of the engine.

4. The camshaft assembly of claim 3, wherein the second cam lobe is phased relative to a third cam lobe fixed on the camshaft, wherein both the second and third cam lobes act on the exhaust valve and contain shortened duration profiles configured to decrease an exhaust pressure, wherein the hydraulic valve actuator selectively actuates at least one intake valve of the engine.

5. The camshaft assembly of claim 2, wherein said second cam lobe actuates an intake valve of a gasoline engine, wherein the hydraulic valve actuator selectively actuates at least one exhaust valve of the engine.

6. The camshaft assembly of claim 5, wherein the hydraulic valve actuator is configured to decrease an exhaust opening duration.

7. The camshaft assembly of claim 2, wherein said second cam lobe selectively actuates an intake valve of a compression ignition engine, and wherein the hydraulic valve actuator selectively actuates at least one exhaust valve.

8. The camshaft assembly of claim 1, wherein the camshaft includes at least one additional phase adjustable lobe.

9. The camshaft assembly of claim 1, wherein the camshaft includes an outer tubular camshaft, and an inner camshaft received within the outer tubular camshaft.

10. The camshaft assembly of claim 1, wherein the hydraulic valve actuator includes a reservoir and a solenoid configured to selectively seal the reservoir.

11. The camshaft assembly of claim 10, wherein the reservoir is configured to selectively transmit mechanical force received from the first lobe to the at least one valve.

12. The camshaft assembly of claim 1, wherein the hydraulic valve actuator is configured to modify the input received from the at least one phase adjustable lobe of the camshaft by adjusting one of a lift and a duration of the input.

13. A camshaft assembly for selectively actuating valves of an engine cylinder, comprising:

a camshaft having a plurality of lobes, including at least one phase adjustable lobe configured to be selectively rotated with respect to the camshaft, and at least one fixed cam lobe defining a fixed valve phase with respect to the camshaft; and a hydraulic valve actuator actuated by the at least one phase adjustable lobe of the camshaft, the hydraulic valve actuator configured to selectively actuate at least one valve in communication with the hydraulic valve actuator in response to the at least one phase adjustable lobe of the camshaft, the hydraulic valve actuator configured to selectively modify an input received from the at least one phase adjustable lobe of the camshaft such that the camshaft assembly is configured to adjust a phase and at least one of a lift and a duration of the at least one valve.

14. A method of assembling a camshaft assembly, comprising:

providing a camshaft having a plurality of lobes, including at least one phase adjustable lobe configured to be selectively rotated with respect to the camshaft; and placing a hydraulic valve actuator in mechanical communication with the at least one phase adjustable lobe of the camshaft, the hydraulic valve actuator configured to selectively actuate a valve in response to actuation by the at least one phase adjustable lobe, the hydraulic valve actuator configured to selectively modify an input received from the at least one phase adjustable lobe of the camshaft such that the camshaft assembly is configured to adjust a phase and at least one of a lift and a duration of the at least one valve.

15. The method of claim 14, further comprising establishing the camshaft as including at least a second cam lobe defining a fixed valve phase with respect to the camshaft.

16. The method of claim 15, further comprising actuating an intake valve of a gasoline engine with said second cam lobe, establishing the at least one valve actuated by the hydraulic valve actuator as an exhaust valve of the engine, and decreasing an exhaust opening duration with the hydraulic valve actuator such that an exhaust pulse separation of the engine is increased.

17. The method of claim 14, wherein the camshaft includes an outer tubular camshaft, and an inner camshaft received within the outer tubular camshaft.

18. The method of claim 14, wherein selectively actuating the valve includes selectively permitting fluid communication of a reservoir to reduce a force transmitted by the reservoir.

19. The method of claim 18, further comprising reducing the force transmitted by the reservoir by opening a solenoid configured to allow selective fluid communication between the reservoir and the environment.

20. The method of claim 18, wherein the force is reduced substantially to zero.

21. The method of claim 14, wherein modifying the input received from the at least one phase adjustable lobe of the camshaft includes adjusting one of a lift and a duration of the input with the hydraulic valve actuator.

* * * * *